US009575465B2

(12) United States Patent
Fussinger et al.

(10) Patent No.: US 9,575,465 B2
(45) Date of Patent: Feb. 21, 2017

(54) PALLET LEVER FOR THE ESCAPEMENT MECHANISM OF A WATCH MOVEMENT

(71) Applicant: Nivarox-FAR S.A., Le Locle (CH)

(72) Inventors: Alexandre Fussinger, Wavre (CH); Marc Stranczl, Nyon (CH); Frederic Vaucher, La Chaux-de-Fonds (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/721,062

(22) Filed: May 26, 2015

(65) Prior Publication Data

US 2015/0355598 A1 Dec. 10, 2015

(30) Foreign Application Priority Data

Jun. 5, 2014 (EP) ..... 14171389

(51) Int. Cl.
*G04B 15/08* (2006.01)
*G04B 15/14* (2006.01)

(52) U.S. Cl.
CPC ..... *G04B 15/08* (2013.01); *G04B 15/14* (2013.01)

(58) Field of Classification Search
CPC ..... G04B 15/00; G04B 15/06; G04B 15/08; G04B 15/14
USPC ..... 368/127–132
See application file for complete search history.

(56) References Cited

U.S. PATENT DOCUMENTS 2,674,890 A * 4/1954 Mosset ..... G04B 15/08 368/132
2,971,324 A * 2/1961 Beyner ..... G04B 15/08 310/39
2011/0149696 A1* 6/2011 Cettour-Baron ..... G04B 15/08 368/131
2012/0090933 A1* 4/2012 Conus ..... G04B 13/022 188/371
2012/0120774 A1* 5/2012 Fujieda ..... G04B 15/14 368/131
2013/0036599 A1 2/2013 Queval et al.
(Continued)

FOREIGN PATENT DOCUMENTS

CH 317532 A 11/1956
CH 703 794 B1 3/2012
(Continued)

OTHER PUBLICATIONS

English Translation of EP2320280, electronically translated Dec. 22, 2015.*
European Search Report of EP 14 17 1389 dated Feb. 24, 2015.

*Primary Examiner* — Edwin A. Leon
(74) *Attorney, Agent, or Firm* — Sughrue Mion, PLLC

(57) ABSTRACT

Pallet lever (2) for the escapement mechanism of a watch movement including a fork portion (4), a pallet-stone holder portion (7), pallet-stones (6) mounted on the pallet-stone holder portion, and a lever (8) interconnecting the pallet-stone holder portion to the fork portion. The fork portion includes a fork (12), guard pin (14) and a stud (16), the lever and the pallet-stone holder portion are integral and form a one-piece main body (3) of the pallet lever, and the fork is an added part secured to the main body by means of the stud driven into a securing hole (18) in the main body and a securing hole (20) in the fork. The stud is manufactured from a hard material, particularly a sapphire.

13 Claims, 3 Drawing Sheets

(56) References Cited

U.S. PATENT DOCUMENTS

| | | | | |
|---|---|---|---|---|
| 2013/0286795 | A1* | 10/2013 | Conus | G04B 13/022<br>368/127 |
| 2013/0309446 | A1* | 11/2013 | Conus | G04B 13/022<br>428/135 |
| 2014/0160901 | A1* | 6/2014 | Cusin | G04B 13/022<br>368/127 |

FOREIGN PATENT DOCUMENTS

| | | | |
|---|---|---|---|
| EP | 2 320 280 | A1 | 5/2011 |
| EP | 2 557 460 | A1 | 2/2013 |

* cited by examiner

PALLET LEVER FOR THE ESCAPEMENT MECHANISM OF A WATCH MOVEMENT

CROSS-REFERENCE TO RELATED APPLICATIONS

This application claims priority from European Patent Application No. 14171389.1 filed on Jun. 5, 2014, the entire disclosure of which is hereby incorporated herein by reference.

BACKGROUND OF THE INVENTION

Field of the Invention

The present invention concerns a pallet lever for the escapement mechanism of a watch movement, particularly a Swiss lever escapement.

Description of Related Art

A pallet lever for a timepiece escapement mechanism is disclosed in EP Patent Application No 2320280. In order to optimise the respective functions of the fork and the lever, the fork is an added part, offset from the plane of the lever and the guard pin. The fork is secured to the lever by means of a stud driven into the respective orifices made in the fork and the lever, the stud also creating the distance between the plane of the lever and of the fork. This distance along an axis perpendicular to the general plane of the pallet lever must be perfectly controlled during manufacture of the pallet lever and particularly during assembly of the guard pin on the lever in order to obtain optimal operation of the mechanism in which the pallet lever is integrated. By way of illustration, the manufacturing tolerance for creating this distance is typically on the order of ±20 μm. In conventional practice, the studs are metal parts of very small diameters made by bar turning. Typically, these studs are produced by bar turning a steel, brass or nickel silver bar. These studs typically have a diameter of around 0.24 mm.

A current problem with bar turned studs is that they have "teats" on the front faces thereof resulting from the parting-off operation during manufacture. Indeed, when the chisel separates the stud from the bar of material at the end of the bar turning operation, the stud is released from the bar and a small cone of material remains on the end surfaces. This small cone of material known as a "teat" is not desired, since it makes it impossible to form a clean end face perpendicular to the cylinder able to serve as reference for an operation to assemble the guard pin on the lever with a precise distance. These studs cannot be driven in "flush" with the lever. Further, it is difficult to assemble the studs since, due to their small dimensions, they tend to deform during assembly resulting in a permanent loss in positioning of the fork relative to the guard pin, which has a negative effect on the performance of the escapement device.

BRIEF SUMMARY OF THE INVENTION

It is an object of the invention to provide a pallet lever for a timepiece escapement mechanism which is accurate and reliable over a long period of use.

It is another object of the invention to provide a robust pallet lever which is economical to manufacture.

It is also an object of the invention to provide a pallet lever for a timepiece escapement mechanism making it possible to optimise the functions of the fork, lever and pallet-stones of the pallets.

Yet another object of the invention is to provide a pallet lever for a timepiece escapement mechanism wherein the distance between the plane of the lever and the guard pin along an axis perpendicular to the general plane of the pallet lever is perfectly controlled.

Objects of the invention are achieved by a pallet lever for a watch escapement mechanism according to claim 1. The dependent claims describe advantageous aspects of the invention.

In the present invention, a pallet lever for the escapement mechanism of a watch movement includes a fork portion, a pallet-stone holder portion, pallet-stones mounted on the pallet-stone holder portion, and a lever interconnecting the pallet-stone holder portion to the fork portion. The fork portion includes a fork, a guard pin and a stud. The lever and the pallet-stone holder portion are integral and form a one-piece main body of the pallet lever, and the fork is an added part secured to the main body by means of the stud driven into and/or assembled in a securing hole in the main body and a securing hole in the fork. The added fork is remote from the main body. The stud is manufactured in a material having no plastic range under stress.

The stud surfaces engaging with the securing holes include a surface finish obtained by grinding and/or polishing.

According to one embodiment, the stud has a hardness greater than or equal to 850 HV. The stud material may be a composite material with a metal matrix, a ceramic, a crystalline or amorphous metal, which may or may not be treated to achieve a surface hardness greater than or equal to 850 HV.

The stud is preferably made from a material selected from the group including sapphire, ruby, aluminium oxide, zirconium oxide, tungsten carbide, single crystal or polycrystalline corundum, silicon nitride, silicon carbide, hardened steel, tungsten carbide in a cobalt matrix and amorphous metal alloys. As amorphous alloys, in particular iron-nickel amorphous alloys and cobalt-nickel based amorphous alloys will be selected, typically the alloy Fe52Ni22Nb6VB15 or the alloy Co50Ni22Nb8V5B15.

Advantageously, the stud has a generally cylindrical shape including at each end thereof a front face extending perpendicularly to the longitudinal axis of the stud. The front faces are less than 1° out of square relative to the axis and preferably the surfaces of the stud engaging with the securing holes and the front faces include a surface finish obtained by grinding.

In one embodiment, the fork is manufactured from a material selected from the group including silicon, silicon nitride, silicon carbide, nickel, nickel-phosphorus alloys (in particular the alloy NiP12), and amorphous alloys, in particular iron-nickel amorphous alloys and cobalt-nickel based amorphous alloys, typically the alloy Fe52Ni22Nb6VB15 or the alloy Co50Ni22Nb8V5B15.

In one embodiment, the main body is manufactured from a material selected from the group of materials including steel, nickel silver alloy, silicon, silicon nitride, silicon carbide, nickel, nickel-phosphorus alloys (in particular NiP12), and amorphous alloys, in particular iron-nickel based amorphous alloys, cobalt-nickel based amorphous alloys and zirconium based amorphous alloys, typically the alloy Fe52Ni22Nb6VB15 or the alloy Co50Ni22Nb8V5B15 or the alloy Zr65.7Cu15.6Ni11.7Al3.7Ti3.3.

In one embodiment, the main body includes a spacer tube arranged around the securing hole and configured to define the distance between the fork and the main body.

In another embodiment, the fork includes a spacer tube arranged around the securing hole and configured to define the distance between the fork and the main body.

The invention also concerns a timepiece escapement mechanism including a pallet lever as described, and a watch movement including an escapement mechanism.

BRIEF DESCRIPTION OF THE DRAWINGS

Other advantageous objects and aspects of the invention will appear upon reading the claims, and the detailed description of embodiments below, and the annexed drawings, in which:

DETAILED DESCRIPTION OF THE INVENTION

Figure 1A:
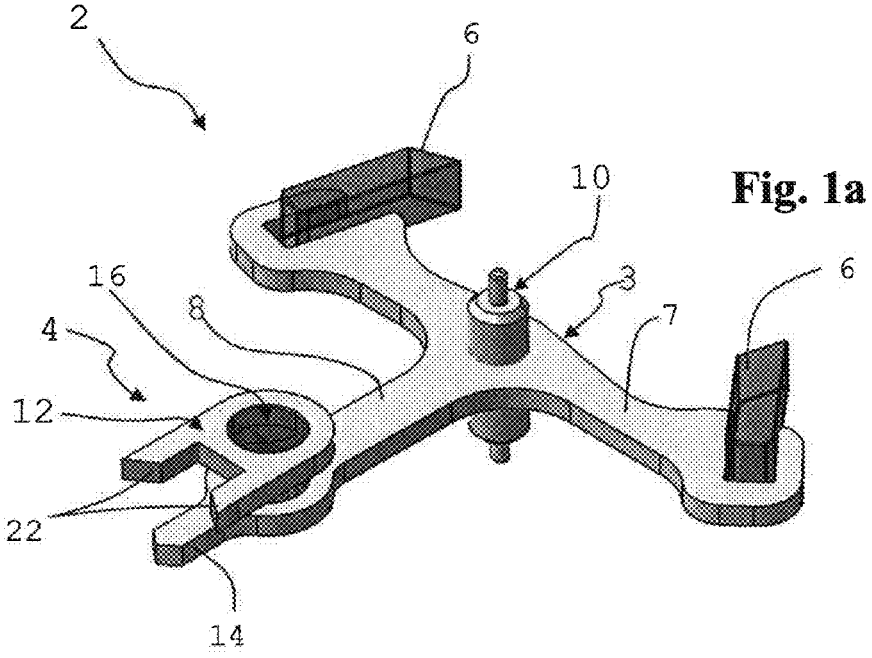
FIG. 1*a* is a schematic perspective view of pallet lever for a Swiss lever escapement mechanism, according to one embodiment of the invention.

With reference to the Figures, a pallet lever 2 for a Swiss lever escapement mechanism for a watch movement, includes a fork portion 4, a pallet-stone holder portion 7, pallet-stones 6 and a lever 8 interconnecting the pallet-stone holder portion to the fork portion. The pallet lever is rotatably mounted in the movement (not shown) by means of a pivot 10.

Pallet-stones 6 cooperate with the teeth of an escape wheel (not shown) of an escapement mechanism which is connected to an energy source supplying a rotational torque to the escape wheel. One of the pallet-stones forms the entry pallet and the other forms the exit pallet, according to the rotational vibration of the pallet lever.

Fork portion 4 includes a fork 12, a guard pin 14 and a stud 16. Fork 12 includes a first horn 22*a* and a second horn 22*b*. The fork conventionally engages with an impulse pin integral with an oscillating wheel of a balance.

In one direction of rotation of the balance, the first horn 22*a* functions as the entry horn and the second horn 22*b* as the exit horn. In the other direction of rotation, the functions of the first and second horns are reversed. The guard pin prevents the pallet lever pivoting such that the fork passes to the wrong side of the impulse pin in the event of a shock. The illustrated mechanism corresponds to a conventional Swiss lever escapement as described in more detail at pages 99 to 128 of the work entitled <<Théorie de l'Horlogerie>> (*The Theory of Horology*) ISBN 2-940025-10-X incorporated herein by reference. As this principle is well known, the conventional elements and the working thereof will not be described in more detail in this Patent Application.

The lever and the arms carrying the pallet-stones are integral and form a main body 3 of pallet lever 2.

Fork 12 is an added part secured to main body 3 by means of stud 16 which is driven into a securing hole 18 arranged in the main body. The distance of the fork from the main body of the pallet lever makes it possible to optimise the function of the fork, particularly in order to decrease losses due to friction between the fork and the impulse pin, without limiting the choice of material and manufacturing method for producing the rest of the pallet lever—the lever, guard pin and pallet-stone holder. The added fork also enables the plane of the fork to be offset relative to the pallet-stones, which makes it possible to produce a compact escapement device.

The fork may be manufactured from various materials including silicon, silicon nitride and silicon carbide, silicon coated with a layer of silicon oxide, silicon coated with a diamond layer, using various manufacturing methods including photolithography methods, and deep reactive ion etching (DRIE) of a wafer made of one of these materials. The fork may also be manufactured from nickel or nickel phosphorus (NiP, NiP12), for example using a LIGA manufacturing method (Röntgenlithographie, Galvanoformung, Abformung). This fork may also be made of a metal or metal alloy in crystalline or amorphous form by mechanical shaping. Iron-nickel based amorphous alloys, for example the alloy Fe52Ni22Nb6VB15, cobalt-nickel based amorphous alloys, for example the alloy Co50Ni22Nb8V5B15 and zirconium-based amorphous alloys, for example the alloy Zr65.7Cu15.6Ni11.7Al3.7Ti3.3 are particularly suitable. The fork could also be made from a copper and beryllium alloy, an austenitic cobalt alloy, austenitic stainless steel or HIS (high interstitial steel).

Main body 3 of pallet lever 2 may also be manufactured from various materials including silicon, silicon nitride and silicon carbide, silicon coated with a layer of silicon oxide, silicon coated with a diamond layer, using various manufacturing methods including photolithography methods and deep reactive ion etching (DRIE). Main body 3 may also be made of titanium, aluminium, magnesium, steel, typically austenitic stainless steel or HIS (high interstitial steel), copper alloy (typically nickel silver or copper beryllium), austenitic cobalt alloy or an austenitic nickel alloy or an amorphous alloy. Iron-nickel based amorphous alloys, for example the alloy Fe52Ni22Nb6VB15, cobalt-nickel based amorphous alloys, for example the alloy Co50Ni22Nb8V5B15 and zirconium-based amorphous alloys, for example the alloy Zr65.7Cu15.6Ni11.7Al3.7Ti3.3 are particularly suitable.

In a first preferred embodiment, main body 3 and fork 12 are made by a LIGA electroforming method from phosphorus nickel, typically NiP12.

In a second preferred embodiment, main body 3 is made by a LIGA method typically from nickel phosphorus or nickel and fork 12 is made by etching typically from a silicon wafer.

Stud 16 is manufactured from a material having no or virtually no plastic range under stress and the stud preferably has a hardness greater than or equal to 850 HV. Typically, the stud is made from a material selected from the group including sapphire, ruby, aluminium oxide, zirconium oxide, single crystal or polycrystalline corundum tungsten carbide, silicon nitride, silicon carbide, hardened steel, tungsten carbide in a cobalt matrix, amorphous alloys, particularly iron-nickel based alloys and cobalt-nickel based amorphous alloys.

The alloy Fe52Ni22Nb6VB15 or the alloy Co50Ni22Nb8V5B15 could typically be used as an amorphous alloy.

In an advantageous embodiment, the stud has a generally cylindrical shape including at each end thereof a front face extending perpendicularly to its longitudinal axis and is made of ruby, including a ground finish to obtain precise dimensions with the following tolerances: circularity ±1 μm, diameter ±1.5 μm, length ±7 μm. In particular the front faces of the stud are less than 1° out of square.

The hardness of the material of the stud, which is greater than or equal to 850 HV, makes it possible to produce the stud with a very precise diameter and front faces that are perfectly perpendicular to each other and therefore the stud can be driven into the orifice in the fork and in body 3 with a reduced risk of these components breaking. The stability of attachment and positioning precision between the stud and these components is also improved compared to conventional assemblies.

Figure 1B:
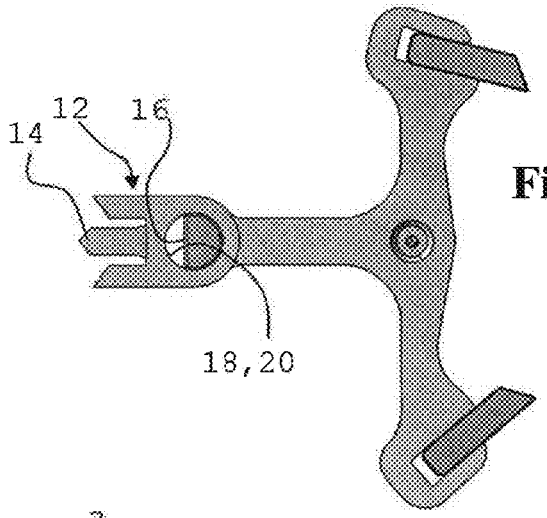
FIG. 1*b* is a plane view of the embodiment of FIG. 1*a*.
Figure 1C:
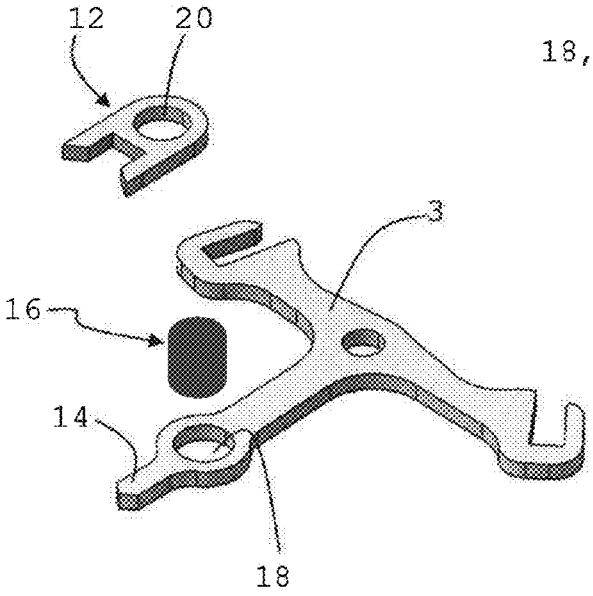
FIG. 1*c* is an exploded perspective view of the embodiment of FIG. 1*a*.

In the embodiment according to FIGS. 1*a* to 1*c*, main body 3 and fork 10 are manufactured by a LIGA type electroforming method, this is a very economical manufacturing method for parts of small dimensions, and also very precise in the thickness direction of the electroformed layer and in the general plane of the main body.

The advantages of this first variant are as follows:

- The geometries are achieved with the precision of the photolithography methods conventionally used to make moulds for the electroforming operation.
- Manufacture of the ruby stud is controlled: the tolerances on the diameter are very fine, typically on the order of (±1.5 μm).
- The ruby stud has no teat on its end faces which are perfectly flat and parallel to each other, unlike bar turned studs.
- Depending on the geometry of the stud (with or without a flat portion) and the shape of orifices 18, 20, the horns of the added fork are indexed relative to the guard pin by means of the assembly method.
- The assembly method does not require adhesive.
- The height precision ensured by this concept ensures tolerances two to three times tighter than a conventional method for assembling the fork on the main body.
- The use of the fork made by a LIGA type electroforming method allows assembly to be achieved by driving in, which makes it possible to adjust the heights independently of the tolerances of the components, which avoids production of a stud with a collar that ensures the distance between the fork and the guard pin.

Figure 2A:
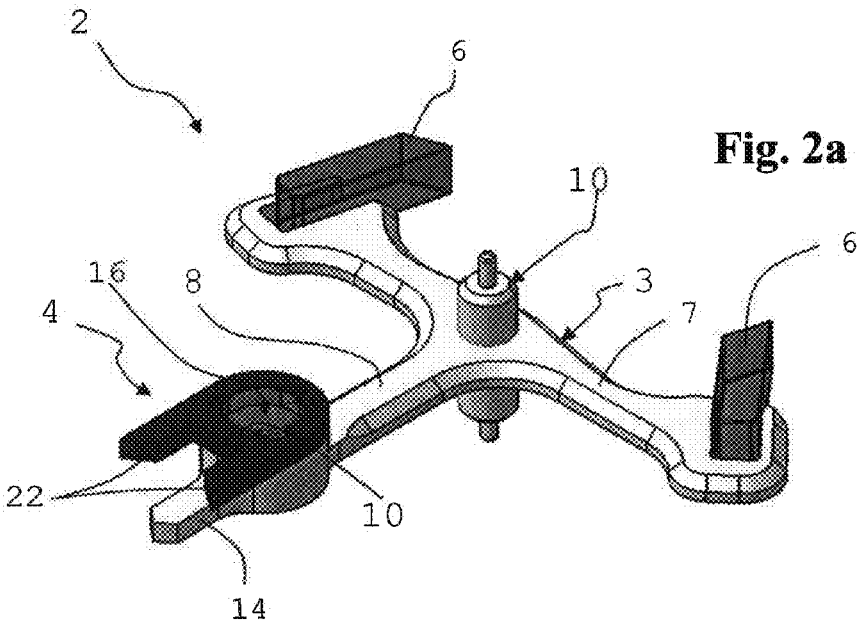
FIG. 2*a* is a schematic perspective view of a pallet lever for a Swiss lever escapement mechanism, according to a second embodiment of the invention.
Figure 2B:
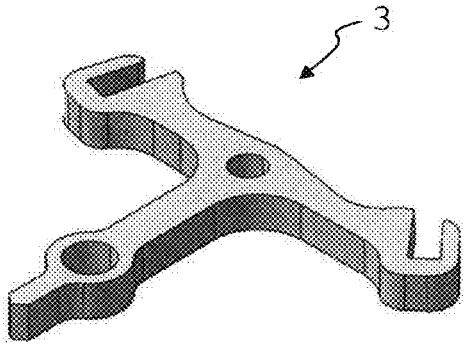
FIG. 2*b* is a perspective view of a body of the pallet lever of FIG. 2*a* during manufacture.
Figure 2C:
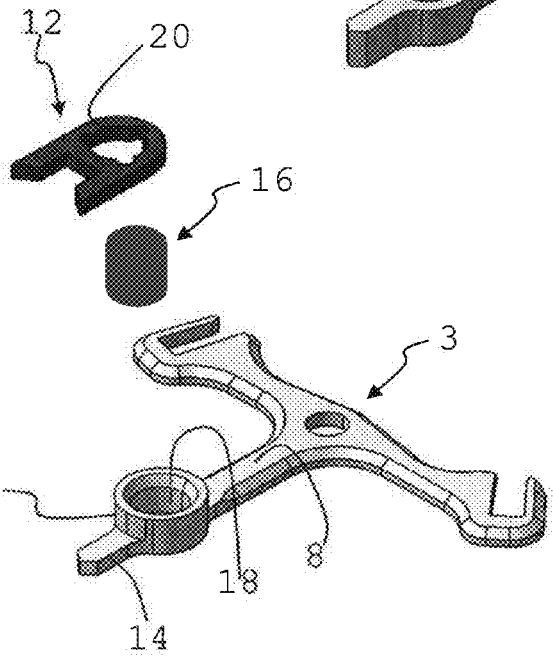
FIG. 2*c* is an exploded perspective view of the embodiment of FIG. 2*a*.

In the second embodiment according to FIGS. 2*a* to 2*c*, main body 3 is manufactured by a LIGA type electroforming method, and then mechanically reworked to form the various levels and bevels. A spacer tube 19*a* is configured around orifice 18 in main body 3, particularly lengthwise, to define the distance between fork 12 and guard pin 14. Fork 10 is produced by etching, typically from a silicon wafer. A ruby stud 16 is driven into the orifice of the plate and the silicon fork is assembled with play on the stud which protrudes and is then adhesive bonded, the fork being pressed against the end surface of spacer tube 19*a*.

The advantages of this second embodiment are as follows:

- The geometries are achieved with the precision of the photolithography methods conventionally used to make moulds for the operation of electroforming the body and to define the shape of the fork in a masking layer before the silicon etch.
- The manufacture of the ruby stud is controlled: the tolerances on the diameter are very fine, typically on the order of ±1.5 μm.
- The ruby stud has no teat and the faces are perfectly flat and parallel to each other, unlike bar turned studs.
- The vertical positioning of the components is very precise.
- The manufacturing and assembly costs are reduced.

Figure 3:
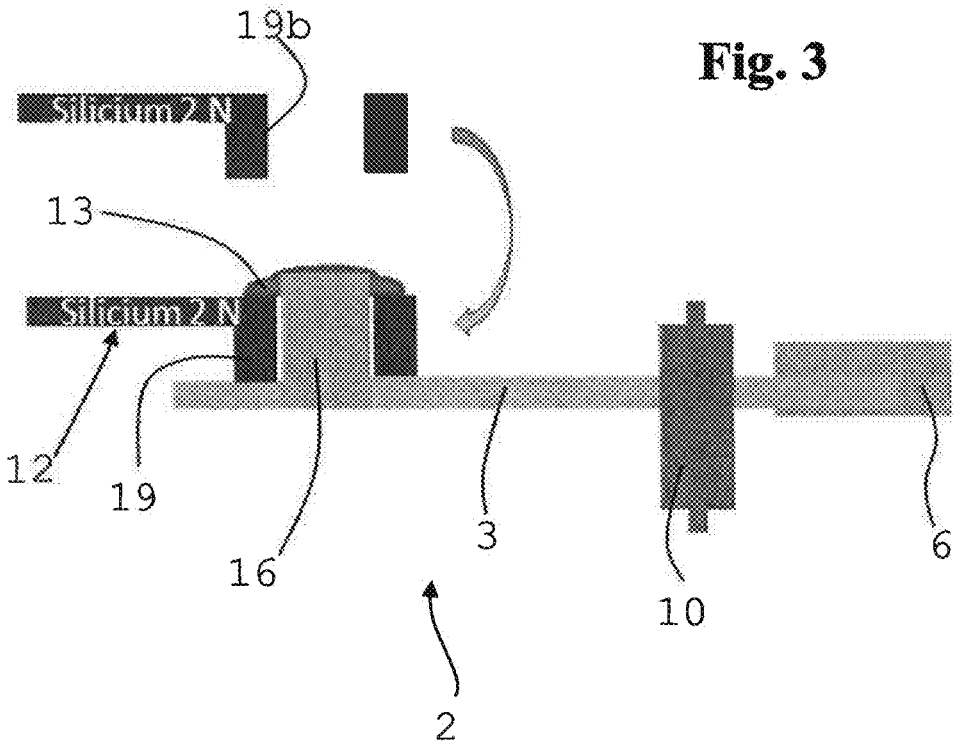
FIG. 3 is a schematic cross-section of a pallet lever for a Swiss lever escapement mechanism, according to a third embodiment of the invention.

In a third embodiment according to FIG. 3, main body 3 is manufactured by a LIGA type electroforming method to form a layer of constant thickness. Fork 10 is achieved by etching, typically from a silicon wafer on at least two levels, to form a spacer tube 19*b* extending around orifice 20 of fork 14. Spacer tube 19*b* is configured, particularly lengthwise, to define the distance between fork 12 and the plate of main body 3. A ruby stud 16 is driven into the orifice of the plate and the silicon fork is assembled with play on the stud which protrudes and is then adhesive bonded, the end of spacer tube 19 of the fork being stopped against the surface of main body 3.

It will be noted generally that the connection between the stud and the fork and/or the main body will be different in nature depending on whether the fork and/or the stud is made of a material with a plastic range (for example metal) or of a brittle material, i.e. having virtually no plastic range (for example silicon, silicon carbide, silicon nitride, etc.). When the fork and/or the main body is made of a material with a plastic range, the stud is driven into the body and/or the fork. When the fork and/or the main body is made of a material with no plastic range, the stud is adhesive bonded in the body and/or the fork.

The invention makes it possible to reduce manufacturing costs and increase production output. It is, in fact, difficult to bar turn current studs in these dimensions and to control the assembly of the stud, plate and guard pin/horns. An important advantage of the use of a stud made of a material having no plastic range under stress to assemble the fork to the main body of the pallet lever is that it resists deformation during assembly, it can be cut and ground with front faces forming perfectly flat and mutually parallel reference faces and precise dimensions. There results, in particular, excellent control of the distance between the fork and the main body during the operation of assembling these two parts.

LIST OF REFERENCES

Escapement mechanism 3
Pallet lever 2
Main body 3
Lever 8
Pallet-stone holder portion 7
Spacer tube 19*a*
Securing orifice/hole 18
Pivot 10
Fork portion 4
Fork 12
First horn 22*a*
Second horn 22*b*
Securing orifice/hole 20
Spacer tube 19*b*
Guard pin 14
Stud 16
Flat portion 24
Pallet-stones 6
Entry pallet
Exit pallet

What is claimed is:

1. A pallet lever for an escapement mechanism of a watch movement, including a fork portion, a pallet-stone holder portion, pallet-stones mounted on the pallet-stone holder portion, and a lever interconnecting the pallet-stone holder portion to the fork portion, the fork portion including a fork, a guard pin and a stud, the lever and the pallet-stone holder portion being integral and forming a one-piece main body of the pallet lever, and the fork is an added part secured to the main body by means of the stud driven into a securing hole in the main body and a securing hole in the fork, the added fork being at a distance from the main body, wherein the stud is manufactured from a material having virtually no elongation at break and a hardness greater than or equal to 850 HV.

2. The pallet lever according to claim 1, wherein at least the surfaces of the stud engaging with the securing holes include a surface finish obtained by grinding.

3. The pallet lever according to claim 1 wherein the stud has a generally cylindrical shape including at each end thereof a front face extending perpendicularly to the longitudinal axis of the stud, wherein the front faces are less than 1° out of square.

4. The pallet lever according to claim 1, wherein the stud is made from a material selected from the group including sapphire, ruby, aluminium oxide, zirconium oxide, tungsten carbide, single crystal or polycrystalline corundum, silicon nitride, silicon carbide, hardened steel, tungsten carbide in a cobalt matrix and amorphous metal alloys.

5. The pallet lever according to claim 1, wherein the fork is manufactured from a material selected from the group of materials including silicon, silicon nitride, silicon carbide, nickel, nickel-phosphorus, steel, amorphous alloys and copper alloys.

6. The pallet lever according to claim 1, wherein the main body is manufactured from a material selected from the group of materials including silicon, silicon nitride, silicon carbide, titanium, aluminium, steel, nickel, nickel-phosphorus, and amorphous alloys.

7. The pallet lever according to claim 1, wherein the fork includes a spacer tube around the securing hole, said tube being configured to define the distance between the fork and the main body.

8. The pallet lever according to claim 1, wherein the main body includes a spacer tube around the securing hole, said tube being configured to define the distance between the fork and the main body.

9. The pallet lever according to claim 1, wherein the main body includes different levels obtained by machining.

10. A timepiece escapement mechanism including a pallet lever for an escapement mechanism of a watch movement, including a fork portion, a pallet-stone holder portion, pallet-stones mounted on the pallet-stone holder portion, and a lever interconnecting the pallet-stone holder portion to the fork portion, the fork portion including a fork, a guard pin and a stud, the lever and the pallet-stone holder portion being integral and forming a one-piece main body of the pallet lever, and the fork is an added part secured to the main body by means of the stud driven into a securing hole in the main body and a securing hole in the fork, the added fork being at a distance from the main body, wherein the stud is manufactured from a material having virtually no elongation at break and a hardness greater than or equal to 850 HV.

11. A watch movement including an escapement mechanism including a pallet lever for an escapement mechanism of a watch movement, including a fork portion, a pallet-stone holder portion, pallet-stones mounted on the pallet-stone holder portion, and a lever interconnecting the pallet-stone holder portion to the fork portion, the fork portion including a fork, a guard pin and a stud, the lever and the pallet-stone holder portion being integral and forming a one-piece main body of the pallet lever, and the fork is an added part secured to the main body by means of the stud driven into a securing hole in the main body and a securing hole in the fork, the added fork being at a distance from the main body, wherein the stud is manufactured from a material having virtually no elongation at break and a hardness greater than or equal to 850 HV.

12. A pallet lever for an escapement mechanism of a watch movement, including a fork portion, a pallet-stone holder portion, pallet-stones mounted on the pallet-stone holder portion, and a lever interconnecting the pallet-stone holder portion to the fork portion, the fork portion including a fork, a guard pin and a stud, the lever and the pallet-stone holder portion being integral and forming a one-piece main body of the pallet lever, and the fork is an added part secured to the main body by means of the stud driven into a securing hole in the main body and a securing hole in the fork, the added fork being at a distance from the main body, wherein the stud is manufactured from a material having virtually no plastic range under stress and wherein the fork includes a spacer tube around the securing hole, said tube being configured to define the distance between the fork and the main body.

13. A pallet lever for an escapement mechanism of a watch movement, including a fork portion, a pallet-stone holder portion, pallet-stones mounted on the pallet-stone holder portion, and a lever interconnecting the pallet-stone holder portion to the fork portion, the fork portion including a fork, a guard pin and a stud, the lever and the pallet-stone holder portion being integral and forming a one-piece main body of the pallet lever, and the fork is an added part secured to the main body by means of the stud driven into a securing hole in the main body and a securing hole in the fork, the added fork being at a distance from the main body, wherein the stud is manufactured from a material having virtually no plastic range under stress and wherein the main body includes a spacer tube around the securing hole, said tube being configured to define the distance between the fork and the main body.

* * * * *